US007543925B2

(12) United States Patent
Ishizawa et al.

(10) Patent No.: US 7,543,925 B2
(45) Date of Patent: Jun. 9, 2009

(54) LIQUID CONTAINER

(75) Inventors: Taku Ishizawa, Nagano (JP); Satoshi Shinada, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 503 days.

(21) Appl. No.: 11/376,370

(22) Filed: Mar. 15, 2006

(65) Prior Publication Data

US 2006/0215002 A1 Sep. 28, 2006

(30) Foreign Application Priority Data

Mar. 28, 2005 (JP) ..... 2005-092470
Feb. 21, 2006 (JP) ..... 2006-043661
Mar. 8, 2006 (JP) ..... 2006-062782

(51) Int. Cl.
*B41J 2/175* (2006.01)

(52) U.S. Cl. ..... 347/85; 347/86

(58) Field of Classification Search ..... 347/86, 347/85, 84

See application file for complete search history.

(56) References Cited

U.S. PATENT DOCUMENTS 5,534,899 A * 7/1996 Uchikata et al. ..... 347/49
5,742,312 A 4/1998 Carlotta
5,764,259 A 6/1998 Nakajima
6,058,984 A * 5/2000 Sato ..... 141/7
6,145,972 A * 11/2000 Udagawa et al. ..... 347/86
2001/0048456 A1 * 12/2001 Higuma ..... 347/86
2002/0130933 A1 9/2002 Chan
2003/0128258 A1 * 7/2003 Hou et al. ..... 347/86
2004/0227795 A1 11/2004 Ujita
2005/0041077 A1 2/2005 Lee

FOREIGN PATENT DOCUMENTS

EP 0 373 302 A1 6/1990
EP 0 429 434 A2 5/1991
EP 0 684 136 A2 11/1995
JP 10-058699 A 3/1998
JP 2004-209847 A 7/2004

OTHER PUBLICATIONS

Combined Search and Examination Report in U.K. patent appln. No. GBP15640A (Jun. 30, 2006).
Extended Search Report from European Patent Appln. 06006381.5-2304, dated Jul. 24, 2006.

* cited by examiner

*Primary Examiner*—Stephen D Meier
*Assistant Examiner*—Sarah Al-Hashimi
(74) *Attorney, Agent, or Firm*—Stroock & Stroock & Lavan LLP

(57) ABSTRACT

A liquid container has an air open passage for causing a liquid chamber to communicate with an outside and introducing outside air into the liquid chamber as liquid in the liquid chamber is consumed, and an air chamber provided in a portion of the air open passage and capable of storing the liquid entering the air open passage. The air open passage includes a lower open passage having one end opened to the liquid chamber at a position close to an internal surface of a bottom wall of the liquid chamber and the other end opened to the air chamber at a position close to an internal surface of a bottom wall of the air chamber, and an upper open passage having one end opened to the air chamber at a position close to an internal surface of a ceiling wall of the air chamber and the other end capable of being opened to the outside.

13 Claims, 6 Drawing Sheets

LIQUID CONTAINER

BACKGROUND OF THE INVENTION

The present invention relates to a liquid container comprising an air chamber capable of storing a liquid entering an air open passage in a container body to be attached removably to a container attachment portion on an apparatus side.

Examples of a liquid container include an ink cartridge to be used in a printer of an ink jet type. In the ink cartridge for the printer of the ink jet type, an ink chamber accommodating an ink to be supplied to a print head is provided in a container body. The ink cartridge is removably fitted and attached to a cartridge attachment portion in a predetermined position in use. The ink accommodated in the ink chamber is supplied to the print head to be driven according to print data transferred from a host computer and is ejected onto a target position of a print medium, such as a paper, from a nozzle provided on the print head.

There have been proposed various ink cartridges of an air open type to be attached to the printer of the ink jet type, in which a container body to be attached removably to a cartridge attachment portion on the printer side includes an ink chamber for accommodating an ink, an ink supply hole provided in communication with the ink chamber and connectable to an ink receiving portion of the cartridge attachment portion, an air open passage for causing the ink chamber to communicate with an outside and introducing outside air into the ink chamber as the ink in the ink chamber is consumed, and an air chamber provided in a portion of the air open passage and capable of storing the ink entering the air open passage.

The air chamber is provided for preventing the ink from leaking out when the air in the ink chamber thermally expands due to a change in an ambient temperature and the ink in the ink chamber flows reversely in the air open passage by the thermal expansion of the air.

The air chamber for preventing the leakage of the ink is required to be devised in a connecting position to the air open passage in such a manner that a function of introducing the air into the ink chamber can be secured also when the cartridge is inclined, for example.

Moreover, it is also important to maintain a volume sufficient to accommodate the ink flowing reversely due to the thermal expansion of the air in the ink chamber, and thus a design is also required for maintaining the volume.

There has been proposed an ink cartridge comprising an air chamber that is provided independently in a lower position on the outside of the ink chamber and is caused to communicate with the ink chamber through a special air introducing path. Both side walls having a comparatively large area in the air chamber are formed by gas-liquid separation films which permit a passage of a gas and does not cause a liquid to pass (for example, see Patent Document 1).

Patent Document 1: JP-A-2004-209847 Publication

When the ink comes in contact with the gas-liquid separation film used for a partition wall of the air chamber, the passing property of the air is reduced in the contact area of the ink. For this reason, a gas permeability to the ink chamber is reduced more greatly than that in the beginning. As a result, there is a possibility that the reduction in the gas permeability to the ink chamber might prevent a smooth supply of the ink.

Furthermore, the gas-liquid separation film having a comparatively large area is caused to function as the partition wall on each of the ends of the air chamber. Therefore, it is necessary to employ a support structure for stably supporting the gas-liquid separation film like a flat wall. Consequently, an increase in components of the air chamber causes a deterioration in an assembling property and an increase in a cost.

Moreover, in a case in which the air chamber is provided on a printer side, it is necessary to air-tightly connect the air open passage between the printer and the ink cartridge, and therefore the formation of such a connection structure increases a cost.

SUMMARY OF THE INVENTION

The invention has been made in view of problems as discussed above.

A liquid container according to an illustrative, non-limiting embodiment comprises: a container body removably attachable to a container attachment portion of an apparatus side; a liquid chamber, provided in the container body, for accommodating a liquid therein; a liquid supply hole in communication with the liquid chamber and connectable to a liquid receiving portion of the apparatus side; an air open passage for causing the liquid chamber to communicate with an outside and introducing outside air into the liquid chamber as the liquid in the liquid chamber is consumed; and an air chamber provided in a portion of the air open passage and capable of storing the liquid entering the air open passage. The air open passage includes: a lower open passage having one end opened to the liquid chamber at a position close to an internal surface of a bottom wall of the liquid chamber and the other end opened to the air chamber at a position close to an internal surface of a bottom wall of the air chamber; and an upper open passage having one end opened to the air chamber at a position close to an internal surface of a ceiling wall of the air chamber and the other end capable of being opened to the outside.

According to the liquid container having such a structure, when the liquid flows reversely in the lower open passage due to the thermal expansion of the air in the liquid chamber storing the liquid therein, the liquid which flows reversely is stored in the air chamber to be extended to an open position of the lower open passage. Therefore, the liquid which flows reversely can be prevented from leaking out.

Also in an upside-down posture, moreover, the opening end of the lower open passage into the liquid chamber is protruded upward from a liquid level position in the liquid chamber. Therefore, the reverse flow through the lower open passage is not caused so that the liquid can be prevented from leaking out.

Moreover, the other end of the lower open passage, which may penetrates through the bottom wall of the air chamber, is opened at the position close to the internal surface of the bottom wall of the air chamber. Therefore, all of the liquid stored in the air chamber can be quickly returned to the liquid chamber by the action of a negative pressure sucking force caused by liquid consumption by the apparatus, or by the action of a negative pressure sucking force generated by a thermal shrinkage of the air in the liquid chamber. Even if the cycle of the thermal expansion and shrinkage is repeated, accordingly, the stored liquid can be prevented from being consumed wastefully by the residue of the liquid in the air chamber.

Furthermore, the air chamber can be formed by partitioning a space of the liquid chamber. Since a special structure is not required for the container attachment portion on the apparatus side, a structure and a configuration can be simplified. By the simplification of the structure and the configuration, it is possible to enhance an assembling property and to reduce a cost.

The other end of the upper open passage may be disposed at a liquid chamber ceiling wall side or at a liquid chamber bottom wall side.

In the liquid container, moreover, it is preferable that: the other end of the lower open passage is disposed close to a corner portion of the internal surface of the bottom wall of the air chamber; the one end of the upper open passage is disposed close to a corner portion of the internal surface of the ceiling wall of the air chamber; and the corner portion of the internal surface of the ceiling wall of the air chamber is located diagonally with respect to the corner portion of the internal surface of the bottom wall of the air chamber as viewed in a direction in which the ceiling wall of the air chamber and the bottom wall of the air chamber are opposed to each other[0015]

According to the liquid container having such a structure, for example, when the liquid container is left in a sideways falling posture, the liquid in the liquid chamber may flow into the air chamber along the lower open passage if the opening of the lower open passage to the liquid chamber sinks in the liquid stored in the liquid chamber. In this case, since the opening of the upper open passage to the air chamber is positioned in a diagonal position with respect to the opening of the lower open passage to the air chamber, the opening of the upper open passage to the air chamber does not come in contact with the liquid flowing into the air chamber so that the liquid flowing into the air chamber can be prevented from leaking out.

On the other hand, even if the liquid container falls sideways in an opposite direction, the liquid in the liquid chamber does not flow into the air chamber through the lower open passage because the opening of the lower open passage to the air chamber is positioned in the upper space of the air chamber above the level of the liquid stored in the liquid chamber. Accordingly, also in this case, the liquid in the liquid chamber can be prevented from leaking out along the air open passage. That is, even if the liquid container takes any posture, the liquid stored in the liquid chamber can be prevented from leaking out.

In the liquid container, furthermore, it is preferable that the air chamber is disposed in an upper part of the liquid chamber, and that a part of a ceiling wall of the liquid chamber lies in a plane in which the ceiling wall of the air chamber lies.

According to the liquid container having such a structure, the liquid flowing reversely in the lower open passage and the upper open passage due to the thermal expansion of the air in the liquid chamber is to go up in each passage against a gravity in a normal state in which the air chamber is positioned in the upper portion of the liquid chamber. For this reason, the reverse flow is difficult to occur, and thus the liquid leakage is difficult to occur. A part of the partition walls of the air chamber, i.e. the ceiling wall of the air chamber, can be formed as a common wall to at least the part of the ceiling wall of the liquid chamber. Consequently, it is possible to define the air chamber by simply adding partition walls other than the ceiling wall. Thus, the air chamber can easily be defined and a cost can be reduced by a decrease in additional structures for the air chamber.

Furthermore, the air chamber is positioned in the upper part of the liquid chamber storing the liquid therein. Therefore, the liquid stored in the air chamber can effectively receives the action of the gravity as well as the action of the negative pressure sucking force caused by the liquid consumption by the apparatus and the action of the negative pressure sucking force generated by the thermal shrinkage of the air in the air chamber. Consequently, the quick return of the liquid from the air chamber to the liquid chamber is further facilitated. Even if the cycle of the thermal expansion and shrinkage is repeated, accordingly, the stored liquid can be prevented from being consumed wastefully due to the residue of the liquid in the air chamber.

Moreover, the air chamber can be of a simple container structure in which the other end opening of the lower open passage communicating with the liquid chamber and the one end opening of the upper open passage communicating with the outside are vertically disposed away from each other. A gas liquid separation film does not need to be used in a partition wall portion with which the stored liquid can come in contact. Therefore, it is possible to prevent a gas permeability from being deteriorated by the contact of the liquid with the partition wall portion in the air chamber. Accordingly, the gas permeability to the liquid chamber can be prevented from being deteriorated during the use of the ink cartridge and an excellent gas permeability to the liquid chamber is maintained stably. Consequently, the smooth supply of the liquid can be maintained stably for a long period of time.

In the liquid container, moreover, it is preferable that a volume of the air chamber is equal to or larger than 10% and equal to or smaller than 30% of a volume of the liquid chamber.

The volume of the air chamber is set in consideration of a range of a temperature change in a use environment in which the liquid container is exposed. In the case in which the liquid container is assumed to be used in a room having a good environment (the change in the temperature ranges from 10° C. to 40° C.), a volume of the air chamber which can permit the change in the temperature to prevent the liquid from leaking is approximately 10% of a total volume of the liquid chamber. In the case in which the liquid container is assumed to be used in the worst environment (the change in the temperature ranges from 30° C. to 60° C.), the volume of the air chamber which can permit the change in the temperature to prevent the leakage of the liquid is approximately 30% of the total volume of the liquid chamber. Accordingly, by setting the volume of the air chamber to be 10% to 30% of the volume of the liquid chamber in the structure described above, the liquid flowing reversely to the air chamber can be prevented from overflowing from the air chamber and leaking out even when the reverse flow is generated at a maximum due to the change in the temperature. Furthermore, it is possible to avoid the excessive size increase of the air chamber, which would otherwise result in the entire size increase of the liquid container.

In the liquid container, moreover, it is preferable that the other end of the upper open passage is sealed with a sealing film.

According to the liquid container having such a structure, the air open passage is perfectly sealed with the sealing film for a period from the manufacture of the liquid container to the utilization of the liquid container by a user. Therefore, it is possible to reliably prevent the liquid from leaking out through the air open passage during a storage or a delivery, and furthermore, to prevent the moisture of the liquid in the liquid chamber from being evaporated through the air open passage. It is possible to prevent the generation of a drawback such as a solidification caused by a rise in a concentration of the liquid.

In the liquid container, moreover, it is preferable that the upper open passage is provided with a gas-liquid separation film which permits a passage of a gas and does not permit a passage of a liquid.

According to the liquid container having such a structure, even in the case in which the temperature change accidentally occurs beyond the assumed temperature change and an unexpected pressure is further applied to the reverse flowing liquid filled in the air chamber, the liquid can be prevented from leaking out by the gas-liquid separation film, resulting in an enhancement in a reliability for the prevention of the leakage. Further, even if the liquid container falls sideways in a state in which the liquid flowing reversely in the lower open passage remains in the air chamber by a thermal expansion generated by the change in the temperature and the opening of the upper open passage to the air chamber sinks in the liquid remaining the air chamber, the liquid can be prevented from leaking out through the upper open passage and the reliability for the prevention of the leakage can be enhanced.

In the liquid container, furthermore, it is preferable that the liquid chamber is partitioned into a first liquid chamber and a second liquid chamber by a partition wall, a coupling passage is provided for causing the first and second liquid chambers to communicate with each other, the coupling passage has one end opened to the first liquid chamber at a position close to an internal surface of a bottom wall of the first liquid chamber and another end opened to the second liquid chamber at a position close to an internal surface of a bottom wall of the second liquid chamber, and one of the first and second liquid chambers communicates with the air chamber through the lower open passage.

According to the liquid container having such a structure, if the amount of storage of the liquid in the liquid chamber in the beginning is distributed in such a manner that one of the first and second liquid chambers is perfectly filled with the liquid and a part of the other liquid chamber is occupied with the liquid, the volume of the air chamber to be secured for preventing the leakage in the reverse flow can be determined to correspond to the volume of the liquid stored in the other liquid chamber. As compared with the case in which the liquid chamber is not divided, the volume of the air chamber can be reduced and the size of the liquid container can be decreased.

In the liquid container, moreover, it is preferable that the first liquid chamber and the second liquid chamber have volumes almost equal to each other.

According to the liquid container having such a structure, the volume of the air chamber to be secured for preventing the leakage can be reduced to be approximately a half as compared with the case in which the liquid chamber is not divided. Thus, it is possible to decrease the size of the liquid container due to a reduction in the volume of the air chamber.

In the liquid container, furthermore, it is preferable that an inside diameter of the coupling passage is set to block a passage of air bubbles by forming a meniscus.

According to the liquid container having such a structure, in the case in which the amount of storage of the liquid in the liquid chamber in the beginning is distributed in such a manner that one of the first and second liquid chambers, to which the lower open passage is opened has a volume occupied partially with the liquid and the other liquid chamber of a hermetically sealing state has a volume entirely (perfectly) filled with the liquid, it is possible to prevent air bubbles from entering the other liquid chamber of the hermetically sealing state until the liquid in the one liquid chamber to which the lower open passage is opened is used up.

In other words, if the inside diameter of the coupling passage is too great to generate a surface tension caused by the meniscus, the air bubbles enter from the one the liquid chamber to the other liquid chamber of the hermetically sealing state before the liquid in the one liquid chamber to which the lower open passage is opened is used up. Consequently, the amount of the liquid flowing reversely in the thermal expansion is increased so that the air chamber requires the same volume as that in the case in which the liquid chamber is not divided. However, it is possible to prevent the generation of the drawback by the structure described above.

One advantage of the invention is such that even if the liquid flows reversely in the air open passage by the thermal expansion of the air in the liquid chamber, the reverse flowing liquid is stored in the air chamber and can be prevented from leaking out.

Another advantage of the invention is such that in the case in which an upside-down posture is taken, the one end of the lower open passage opened to the liquid chamber can be protruded upward from the liquid level position in the liquid chamber. Accordingly, the reverse flow passing through the lower open passage is not generated so that the liquid can be prevented from leaking out.

Yet another advantage of the invention is such that the other end of the lower open passage is opened at the position close to the internal surface of the bottom wall of the air chamber, and therefore, all of the liquid stored in the air chamber can be quickly returned to the liquid chamber in the thermal shrinkage of the air in the liquid chamber. Even if the cycle of the thermal expansion and shrinkage is repeated, the stored liquid can be prevented from being consumed wastefully due to the residue of the liquid in the air chamber.

Further another advantage of the invention is such that, the air chamber can be formed by partitioning a space of the liquid chamber, and therefore a cost increase for forming the air chamber can be eliminated.

The above-noted advantages and other advantages of the invention, and associated structure thereof will be discussed in more detail with reference to illustrative, non-limiting embodiments shown in the accompanying drawings.

The present disclosure relates to the subject matter contained in Japanese patent application Nos. 2005-092470 (filed on Mar. 28, 2005), 2006-043661 (filed on Feb. 21, 2006) and 2006-62782 (filed on Mar. 8, 2006), each of which is expressly incorporated herein by reference in its entirety.

DESCRIPTION OF THE PREFERRED EMBODIMENT

Figure 1:
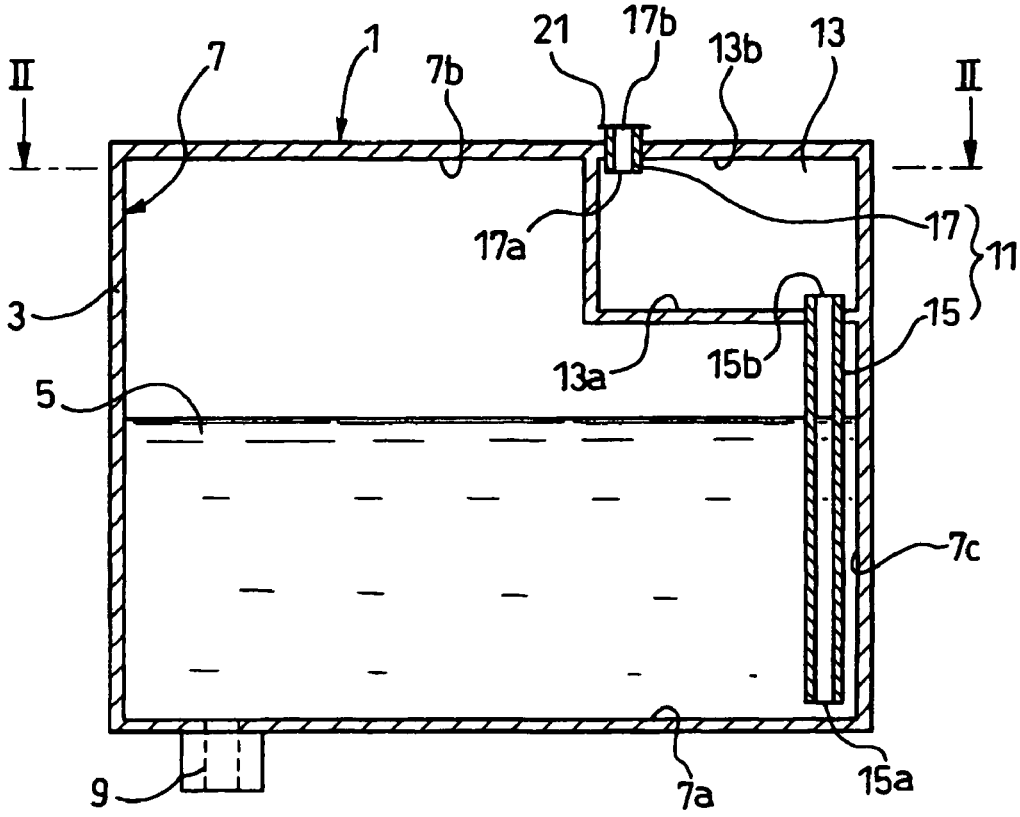
FIG. 1 is a longitudinal sectional view showing a schematic structure of an ink cartridge according to a first embodiment of a liquid container in accordance with the invention.
Figure 2:
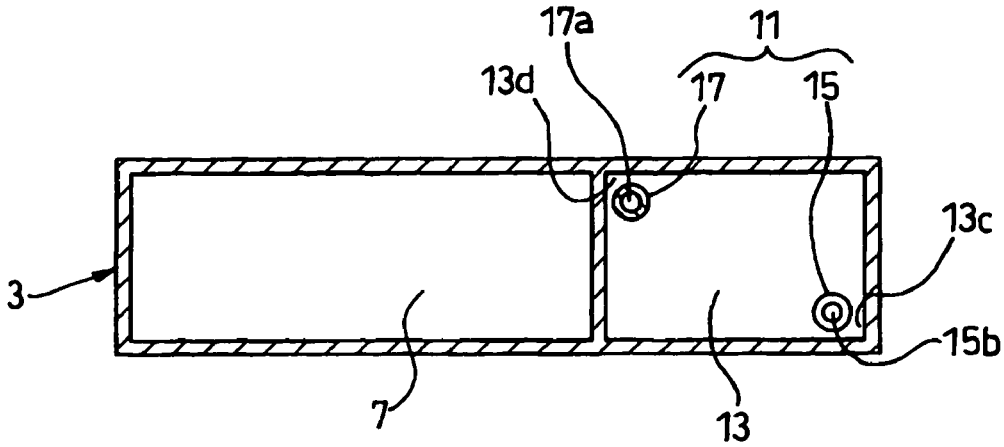
FIG. 2 is a sectional view taken along a II-II line in FIG. 1.
Figure 3:
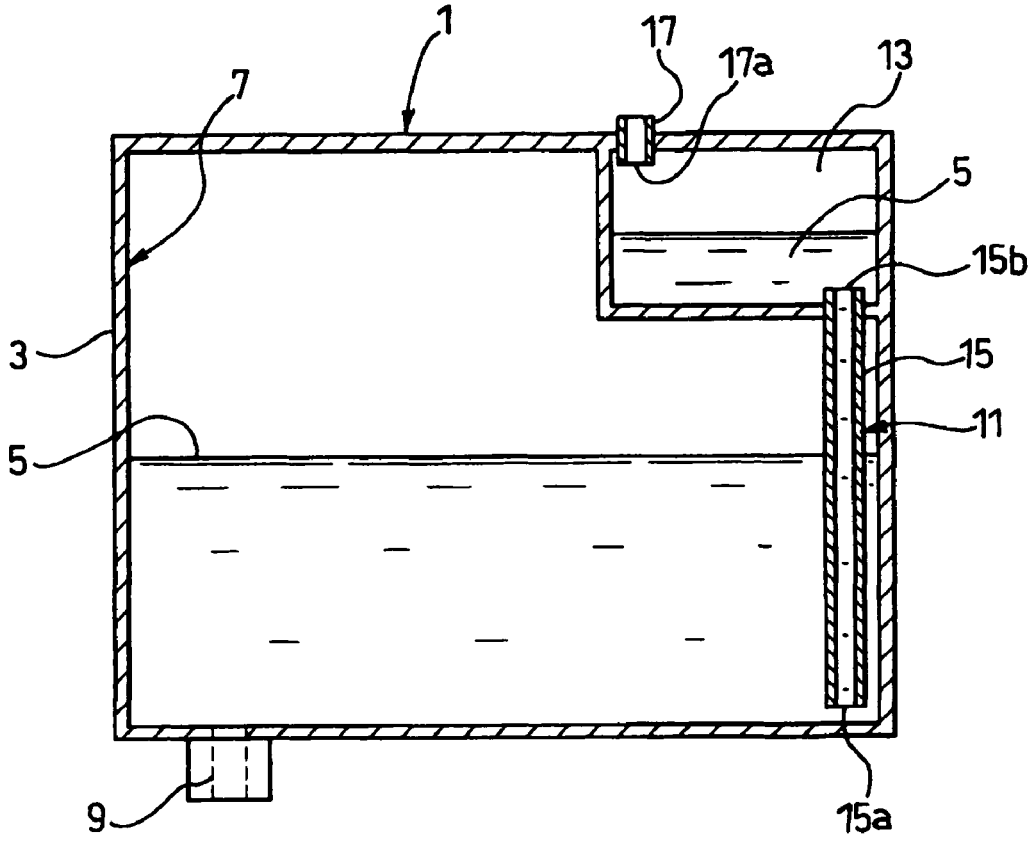
FIG. 3 is an explanatory view showing a state in which an ink liquid in a liquid chamber in the ink carriage illustrated in FIG. 1 flows reversely in a lower open passage by a thermal expansion of air and is stored in an air chamber.
Figure 4:
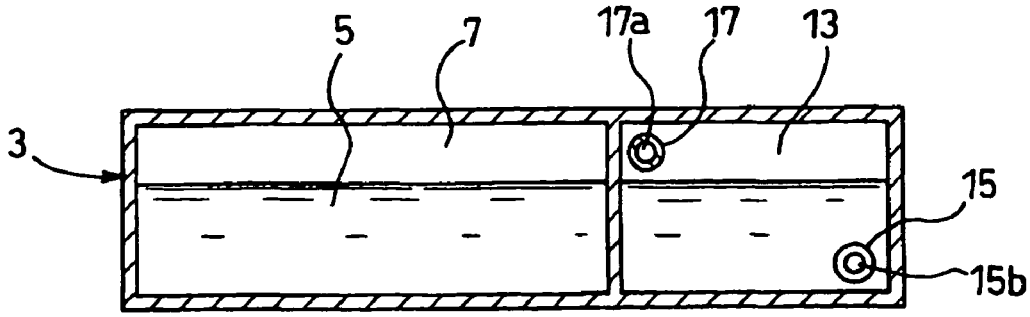
FIG. 4 is a sectional view showing a state in which the ink cartridge illustrated in FIG. 1 falls sideways toward one side and the ink liquid in the liquid chamber flows into the air chamber.
Figure 5:
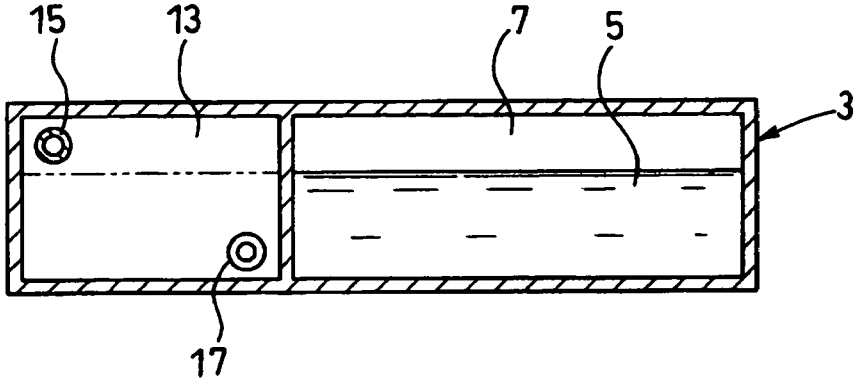
FIG. 5 is a sectional view showing a state of the ink liquid in the liquid chamber which is brought when the ink cartridge illustrated in FIG. 1 falls sideways toward a reverse side to that in FIG. 4.

FIGS. 1 to 5 show an ink cartridge according to a first embodiment of a liquid container in accordance with the invention. FIG. 1 is a longitudinal sectional view showing a schematic structure of the ink cartridge according to the first embodiment. FIG. 2 is a sectional view taken along a II-II line in FIG. 1¥ FIG. 3 is an explanatory view showing a state in which an ink in a liquid chamber in the ink cartridge illustrated in FIG. 1 flows reversely through a lower open passage by a thermal expansion of air and is stored in an air chamber. FIG. 4 is a sectional view showing a state in which the ink cartridge illustrated in FIG. 1 falls sideways toward one side and the ink in the liquid chamber flows into the air chamber. FIG. 5 is a sectional view showing a state of the ink in the liquid chamber which is brought when the ink cartridge illustrated in FIG. 1 falls sideways toward an opposite side to that in FIG. 4.

The liquid container according to the embodiment is discussed by taking, as an example, an ink cartridge that is attachable to a cartridge attachment portion on a carriage having a print head serving as a liquid ejecting portion in an ink jet type printer.

An ink cartridge 1 according to the first embodiment of the invention serves to supply an ink to a print head. The ink cartridge 1 has a container body 3 that is formed to take an external shape of an almost rectangular parallelepiped and that can be attached removably to a container attachment portion (a cartridge attachment portion) on the printer side. There are provided, in the container body 3, an ink chamber (a liquid chamber) 7 for accommodating an ink (a liquid) 5 therein, an ink supply hole 9 in communication with the ink chamber 7 and connectable to an ink receiving portion (a liquid receiving portion) on the printer side, an air open passage 11 for causing the ink chamber 7 to communicate with an outside and introducing outside air into the ink chamber 7 as the ink 5 in the ink chamber 7 is consumed, and an air chamber 13 provided in the middle of the air open passage 11 and capable of storing the ink 5 flowing reversely in the air open passage 11.

In general, a tip opening portion of the ink supply hole 9 is sealed with a sealing film in a non-use state. When the ink cartridge 1 is attached to the cartridge attachment portion provided on the carriage of the printer, the sealing film is pierced by means of an ink supply needle provided on the cartridge attachment portion side so that the sealing is released and the ink can be supplied.

The air chamber 13 is defined (partitioned) in an upper space (that is, a space into which the air flows) of the ink chamber 7 to be a hermetically sealing space capable of storing the ink 5. The air chamber 13 is located in the upper space of the ink chamber 7, and offset toward a side wall 7*c*. Preferably, the air chamber 13 is defined using at least one of the side wall 7*c* and a ceiling wall 7*b* which are used to define the ink chamber 7. The air chamber 13 takes the shape of a rectangular parallelepiped.

In the embodiment, as discussed above, a part of the ceiling wall 7*b* of the ink chamber 7 forms a ceiling wall 13*b* of the air chamber 13 so that the air chamber 13 is offset to an upper side of the ink chamber 7. A volume of the air chamber 13 is set to be 10% to 30% of a total volume V1 of the ink chamber 7.

The air open passage 11 is divided into a lower open passage 15 and an upper open passage 17.

The lower open passage 15 has one end 15*a* opened to the ink chamber 7 at a position close to an internal surface of a bottom wall 7*a* of the ink chamber 7 and another end 15*b* opened to the air chamber 13 at a position close to an internal surface of the bottom wall 13*a* of the air chamber 13. In this embodiment, the lower open passage 15 penetrates through a bottom wall 13*a* of the air chamber 13. The lower open passage 15 may bypass the bottom wall 13*a*.

The upper open passage 17 has one end 17*a* opened to the air chamber 13 at a position close to an internal surface of the ceiling wall 13*b* of the air chamber 13 and another end 17*b* opened to an outside. In this embodiment, the upper open passage 17 penetrates through the ceiling wall 13*b*, and the other end 17*b* of the upper open passage 17 is formed as an air open hole. The upper open passage 17 may bypass the ceiling wall 13*b*. The other end 17*b* may be formed as an exposed portion of a groove that is formed in the container body 3 and that is covered by a film, attached to the container body 3, with the exception of the exposed portion.

The openings 15*a* and 15*b* on respective ends of the lower open passage 15 are located at positions close to the side wall 7*c* in the ink chamber 7 and the air chamber 13 as shown in FIG. 1. As shown in FIG. 2, the opening 17*a* on one end of the upper open passage 17 is located at a position close to a corner portion 13*d* that is a diagonal position with respect to a corner portion 13*c* where the other end 15*b* of the lower open passage 15 is opened, as viewed in a rectangular section of the air chamber 13.

In the embodiment, the corner portion 13*c* of the air chamber 13 overlaps with the side wall 7*c* defining the ink chamber 7.

In the embodiment, the other end (air open hole) 17*b* of the upper open passage 17 is sealed with a sealing film 21 as shown in FIG. 1.

According to the ink cartridge 1, when the stored ink 5 stored in the ink chamber 7 flows reversely in the lower open passage 15 by a thermal expansion of the air in the ink chamber 7, the reverse flowing ink 5 is stored in the air chamber 13 defined around an opening position of the lower open passage 15 as shown in FIG. 3. Therefore, it is possible to prevent the reverse flowing ink 5 from leaking out.

When the ink cartridge 1 is removed from the cartridge attachment portion, even if the ink cartridge 1 is caused to take an upside-down posture, the opening end of the lower open passage 15 to the ink chamber 7 is protruded upward from a liquid level position in the ink chamber 7. Therefore, a reverse flow through the lower open passage 15 is not caused. Also in this case, the ink 5 can be prevented from leaking out.

Moreover, since the other end 15*b* of the lower open passage 15 is opened at the position close to the internal surface of the wall 13*a*. Therefore, all of the ink 5 stored in the air chamber 13 can be quickly returned to the ink chamber 7 by the action of a negative pressure sucking force generated by a thermal shrinkage of the air in the ink chamber 7 and the action of a gravity in the thermal shrinkage. Even if the cycle of the thermal expansion and shrinkage is repeated, the stored ink 5 can be prevented from being consumed wastefully due to the residue of the ink 5 in the air chamber 13.

The action for returning the ink to the ink chamber 7 can function more effectively because the air chamber 13 is positioned in an upper part of the ink chamber 7 for storing the ink 5 therein. Also in the case in which the air chamber 13 is provided in a lower part of the ink chamber 7, the same advantages can be obtained if the other end 15*b* of the lower open passage 15 is opened in the position close to the internal surface of the bottom wall 13*a*.

Moreover, the air chamber 13 is of a simple container structure in which the opening 15*b* on the other end of the lower open passage 15 communicating with the ink chamber 7 and the opening 17*a* on the one end of the upper open passage 17 communicating with the outside are disposed vertically away from each other, and a gas-liquid separation film is not used in a partition wall portion with which the stored ink 5 can come in contact. Therefore, a gas permeability can be prevented from being deteriorated due to the contact of the ink 5 with the partition wall portion of the air chamber 13.

Accordingly, the gas permeability to the ink chamber 7 can be prevented from being deteriorated during the use of the ink cartridge 1 and an excellent gas permeability to the ink chamber 7 is maintained stably. Consequently, a smooth supply of the ink can be maintained stably for a long period of time.

Furthermore, the air chamber 13 is partitioned in the upper space of the ink chamber 7, and a special structure for a container attachment portion on an apparatus side is not required differently from a conventional product in which the air chamber 13 is independently formed on the outside of the ink chamber 7. Therefore, a structure and a configuration can be simplified. By the simplification of the structure and the configuration, an assembling property can be enhanced and a cost can be reduced.

In the embodiment, moreover, in the case in which the ink cartridge 1 is left in a sideways falling posture so that the opening 15*a* of the lower open passage 15 in the ink chamber 7 sinks in the ink 5 stored in the ink chamber 7, for example, the ink 5 in the ink chamber 7 may flow into the air chamber 13 along the lower open passage 15 as shown in FIG. 4. Since the end opening 17*a* of the upper open passage 17 for causing the air chamber 13 to communicate with the outside is placed in a diagonal position with respect to the end opening 15*b* of the lower open passage 15, the end opening 17*a* of the upper open passage 17 does not come in contact with the ink 5 flowing into the air chamber 13. Consequently, the ink 5 flowing into the air chamber 13 can be prevented from leaking out.

On the other hand, even if the ink cartridge 1 falls sideways in the opposite way as shown in FIG. 5, the ink 5 in the ink chamber 7 does not flow into the air chamber 13 through the lower open passage 15 in the case in which the opening 15*a* of the lower open passage 15 in the ink chamber 7 is positioned in an upper space of the ink 5 stored in the ink chamber 7 as shown in FIG. 5. Also in this case, the ink 5 in the ink chamber 7 can be prevented from leaking out along the air open passage 11.

Accordingly, even if the ink cartridge 1 is brought into a sideways falling state in any direction, the ink 5 stored in the ink chamber 7 can be prevented from leaking out.

In a normal use state in which the ink cartridge 1 according to the embodiment is used such that the air chamber 13 is positioned in an upper part of the ink chamber 7, the ink 5 flowing reversely in the lower open passage 15 and the upper open passage 17 by the thermal expansion of the air in the ink chamber 7 is to go up through each of the passages against the gravity. Therefore, the reverse flow and the leakage to the outside are difficult to occur.

Moreover, the ceiling wall 13*b* of the ink chamber 7 is commonly used to define the air chamber 13. Therefore, it is possible to partition the air chamber 13 by simply adding partition walls other than the ceiling wall 13*b*. Thus, the air chamber 13 can easily be partitioned. Consequently, it is possible to reduce a cost by a decrease in additional structures for the air chamber 13.

A coefficient of volumetric expansion A obtained when a temperature of air is changed from T1° C. to T2° C. is represented in the following equation [1].

$$A=(T2+273)/(T1+273) \quad [1]$$

When the ink chamber 7 is completely filled with the ink 5 and the air is not present at all in the ink chamber 7, a thermal expansion force of the air does not act even if the temperature is changed. Consequently, the reverse flow of the ink 5 stored in the ink chamber 7 is not generated. In an empty state in which the ink 5 does not remain in the ink chamber 7, the reverse flow of the ink 5 is not generated even if the air in the ink chamber 7 expands thermally.

In a state in which both the ink 5 and the air are stored in the ink chamber 7, the reverse flow of the ink 5 is generated.

The following equation [2] is established, wherein a total volume of the ink chamber 7 is represented by V1, a volume of the air remaining in the ink chamber 7 is represented by V2, and a volume of the ink 5 stored in the ink chamber 7 is represented by V3.

$$V1=V2+V3 \quad [2]$$

The amount of the ink 5 flowing reversely to the air chamber 13 is maximized in the case in which the air remaining in the ink chamber 7 expands to the total volume V1 of the ink chamber 7 by a thermal expansion so that the total amount (V3) of the ink 5 stored in the ink chamber 7 completely flows reversely to the air chamber 13. The following equation [3] is established.

$$V2\times A=V1 \quad [3]$$

From the equations [2] and [3], the following equation is obtained.

$$V3=(A-1)/(A\times V1) \quad [4]$$

When the volume of the air chamber 13 is set to be larger than V3, it is possible to reliably prevent the leakage of the ink 5 which flows reversely. However, there is a possibility that the volume might become excessive to leave a wastefully empty space in the air chamber 13, resulting in an increase in the size of the ink cartridge 1. On the other hand, if the volume of the air chamber 13 is set to be smaller than V3, there is a possibility that the ink 5 might leak out of the air chamber 13 when the reverse flow reaches a maximum amount. Accordingly, it is optimum that the volume of the air chamber 13 is set to be V3.

Therefore, the following equation is established when a ratio of the total volume V1 of the ink chamber 7 to the maximum volume V3 to be provided for the air chamber 13 is represented by B.

$$B=V3/V1 \quad [5]$$

If the equation [4] is substituted for the equation [5], the following equation is established.

$$B=(A-1)/A \quad [6]$$

Accordingly, a change in a temperature of an environment in which the ink chamber 7 is used is set and the coefficient of volumetric expansion A for the change in the temperature is obtained from the equation [1] and is substituted for the equation [6] so that it is possible to obtain the volume ratio B of the air chamber 13 which permits the change in the temperature and can prevent the leakage of the ink 5.

A range of the change in the temperature at which the ink cartridge 1 is exposed in a use environment is set into three ways which will be described below, for example.

A first temperature condition assumes the case of use in a room having a good environment, and the change in the temperature ranges from 10° C. to 40° C.

A second temperature condition assumes the worst case in which the good environment is not given, and the change in the temperature ranges from −30° C. to 60° C., for example.

A third temperature condition assumes a middle range between the first temperature condition and the second temperature condition, and the change in the temperature ranges from −20° C. to 40° C.

T1=40 and T2=10 are substituted for the equation [1] so that the coefficient of volumetric expansion A on the first temperature condition is equal to 1.1060. At this time, the volume ratio B of the air chamber 13 is equal to 0.0958 from the equation [6]. By setting the volume of the air chamber 13 to be approximately 10% of the total volume of the ink chamber 7 on the same temperature condition, accordingly, it is possible to obtain an optimum ink cartridge 1 which does not cause the leakage.

On the other hand, T1=60 and T2=−30 are substituted for the equation [1] so that the coefficient of volumetric expansion A on the second temperature condition is equal to 1.3704. At this time, the volume ratio B of the air chamber 13 is equal to 0.2703 from the equation [6]. By setting the volume of the air chamber 13 to be approximately 30% of the total volume of the ink chamber 7 on the same temperature condition, accordingly, it is possible to obtain the optimum ink cartridge 1 which does not cause the leakage.

It can be supposed that the range of the change in the temperature at which the ink cartridge 1 is exposed in a normal use environment is present between the case of the first temperature condition and that of the second temperature condition.

If the volume of the air chamber 13 is usually set to be 10% to 30% of the volume of the ink chamber 7 as described in the embodiment, accordingly, the ink 5 flowing reversely to the air chamber 13 can be prevented from overflowing from the air chamber 13 and leaking out, and furthermore, the size of the ink cartridge 1 can be prevented from being increased due to an excessive enlargement of the air chamber 13 also when the reverse flow is generated at a maximum by the change in the temperature.

It is preferable that the volume ratio of the air chamber 13 is determined to prevent the reverse flowing ink 5 from overflowing from the air chamber 13 on the third temperature condition. T1=40 and T2=−20 are substituted for the equation [1] so that the coefficient of volumetric expansion A on the third temperature condition is equal to 1.3704. At this time, the volume ratio B of the air chamber 13 is equal to 0.1917 from the equation [6]. By setting the volume of the air chamber 13 to be approximately 20% of the total volume of the ink chamber 7 on the same temperature condition, accordingly, it is possible to obtain the optimum ink cartridge 1 which does not cause the leakage.

Referring to the ink cartridge 1, furthermore, the air open passage 11 is perfectly sealed with the sealing film 21 for a period in which the ink cartridge 1 is manufactured and is then utilized initially by a user. Therefore, it is possible to reliably prevent the ink 5 from leaking out of the air open passage 11 during a storage and a delivery, and furthermore, to prevent the moisture of the ink 5 in the ink chamber 7 from being evaporated through the air open passage 11. Therefore, it is possible to prevent the generation of a drawback such as a solidification due to a rise in the concentration of the ink 5.

For the removal of the sealing film 21 in use, it is conceivable to propose a method of manually peeling and removing the sealing film 21 by the user before attaching the ink cartridge 1 to the container attachment portion of the apparatus, and furthermore, a method of providing a sealing release needle for breaking the sealing film 21 on the container attachment portion side of the apparatus.

Figure 6:
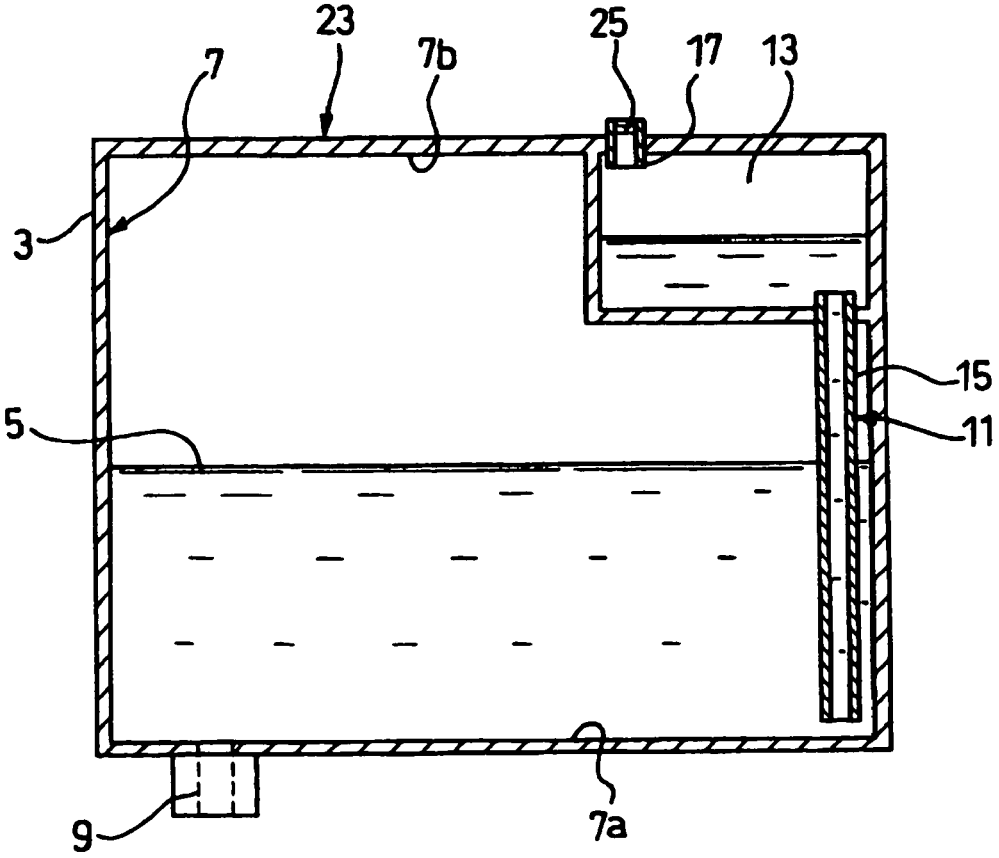
FIG. 6 is a longitudinal sectional view showing a schematic structure of an ink cartridge according to a second embodiment of the liquid container in accordance with the invention.

FIG. 6 is a longitudinal sectional view showing a schematic structure of an ink cartridge according to a second embodiment of the liquid container in accordance with the invention.

In an ink cartridge 23 according to the second embodiment, a gas-liquid separation film 25 which permits the passage of a gas and does not permit the passage of an ink 5 is provided in an upper open passage 17 in the ink cartridge 1 according to the first embodiment, and other structures are the same as those in the first embodiment. The same structures as those in the first embodiment have the same or corresponding designations in the drawing and description will be thus simplified or omitted.

By such a structure, even in the case in which a change in a temperature is greater than a range of a change in the temperature which is assumed and a pressure is further applied to the reverse flowing ink 5 filled in an air chamber 13, the ink 5 can be prevented from leaking out by the gas-liquid separation film 25 so that a reliability for the prevention of the leakage can be enhanced.

Further, even if the ink 5 flowing reversely in a lower open passage 15 due to a thermal expansion caused by the change in the temperature remains in the air chamber 13, and the ink cartridge 1 falls sideways in this state so that the opening of the upper open passage 17 in the air chamber 13 sinks in the ink 5 remaining in the air chamber 13, the ink 5 can be prevented from leaking out of the upper open passage 17 so that the reliability for the prevention of the leakage can be enhanced.

Figure 7:
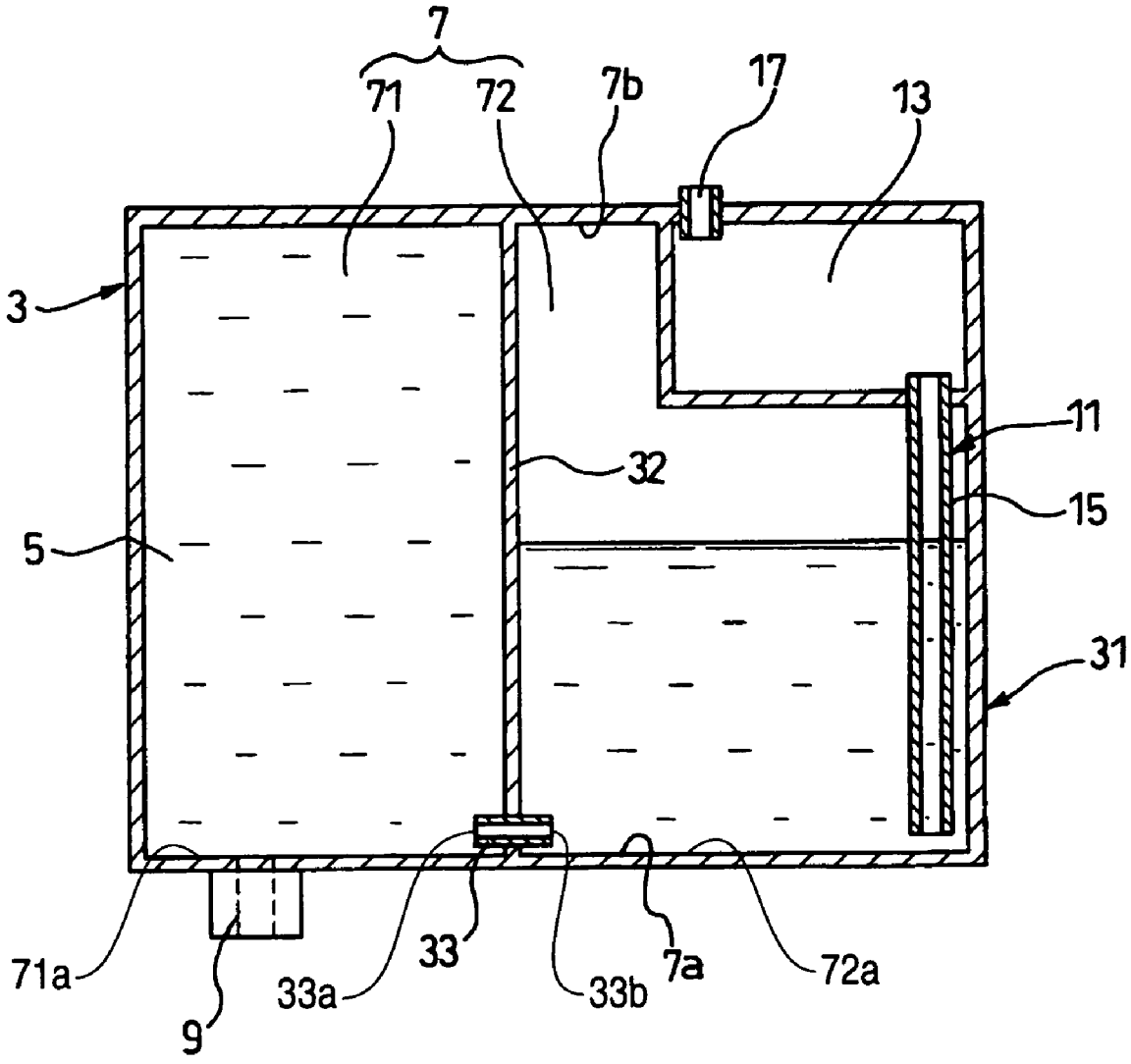
FIG. 7 is a longitudinal sectional view showing a schematic structure of an ink cartridge according to a third embodiment of the liquid container in accordance with the invention.

FIG. 7 is a longitudinal sectional view showing a schematic structure of an ink cartridge according to a third embodiment of the liquid container in accordance with the invention.

In an ink cartridge 31 according to the third embodiment, an ink chamber 7 in the ink cartridge 1 according to the first embodiment is divided into a first ink chamber 71 and a second ink chamber 72 by a partition wall 32 which extends in a vertical direction for partitioning an inside of the ink chamber 7. The ink cartridge 31 further has a coupling passage 33 for causing the first and second ink chambers 71 and 72 to communicate with each other at positions close to bottom walls of the first and second chambers 71 and 72. More specifically, the coupling passage 33 has one end 33*a* opened to the first ink chamber 71 at a position close to an internal surface of a bottom wall 71*a* of the first chamber 71, and another end 33*b* opened to the second ink chamber 72 at a position close to an internal surface of a bottom wall 72*a* of the second ink chamber 172. The second ink chamber 72 positioned close to the side wall 7*c* than the first ink chamber 71 communicates with the air chamber 13 through the lower open passage 15. The first ink chamber 71 communicates with the ink supply hole 9. Other structure, such as positions of the opening ends of the lower open passage 15 and upper open passage 17 constituting the air open passage 11, and a position and a shape of the air chamber 13 may be the same as those of the first embodiment.

In the third embodiment, a dimension and a position of the partition wall 32 is set in such a manner that volumes of the first ink chamber 71 and the second ink chamber 72 are almost equal to each other.

In the third embodiment, furthermore, the coupling passage 33 has an inside diameter set to block the passage of air bubbles by forming a meniscus.

In the ink cartridge 31 according to the third embodiment described above, if an amount of storage of the ink in each of the ink chambers 71 and 72 in the beginning is set in such a manner that the first ink chamber 71 is perfectly filled and a part of the second ink chamber 72 is occupied with an ink 5 as shown in FIG. 7, it is sufficient that the volume of the air chamber 13 to be secured for preventing a leakage caused by a reverse flow is determined to correspond to that of the ink 5 stored in the second ink chamber 72. That is, the volume of the air chamber 13 can be set, taking into account only the volume of the second ink chamber 72, the amount of the ink stored in the second ink chamber 72 or the like. As compared with the case in which the ink chamber is not divided, it is possible to decrease the size of the ink cartridge 31 by a reduction in the volume of the air chamber 13.

The first and second ink chambers 71 and 72 obtained by the division communicate with each other through the coupling passage 33 in the positions close to the bottom walls of the first and second ink chambers 71 and 72. That is, the coupling passage 33 functions as a communicating pipe. Since an ink supply hole 9 is provided on the bottom wall of the first ink chamber 71 communicating with the second ink chamber 72 through the coupling passage 33, a total amount of the stored ink 5 can be supplied to the outside through the ink supply hole 9. That is, this arrangement eliminates a possibility that a part of the stored ink 5 is unused and left in the ink chamber 7 without a flow to the ink supply hole 9.

If the volumes of the first ink chamber 71 and the second ink chamber 72 are set to be almost equal to each other as in the ink cartridge 31, the volume of the air chamber 13 to be secured for preventing the leakage can be reduced to be approximately a half of that in the case in which the ink chamber 7 is not divided. Consequently, it is possible to easily decrease the size of the ink cartridge 31 due to a reduction in the volume of the air chamber 13.

In the ink cartridge 31, the inside diameter of the coupling passage 33 is set to utilize a surface tension of the meniscus as in the embodiment. Further, the amount of the ink 5 stored in each of the ink chambers 71 and 72 in the beginning is set in such a manner that the second ink chamber 72 on a side where the lower open passage 15 is opened has a volume occupied partially with the ink 5 and the first ink chamber 71 of the hermetic closing state has a total volume filled perfectly with the ink 5. Accordingly, it is possible to prevent air bubbles from entering the first ink chamber 71 of the hermetically sealing state until the ink 5 in the second ink chamber 72 to which the lower open passage 15 is opened is used up[0064]

More specifically, if the inside diameter of the coupling passage 33 is too great to generate the surface tension of the meniscus, the air bubbles can enter the first ink chamber 71 from the second ink chamber 72 side before the ink 5 in the second ink chamber 72 is used up. Consequently, an amount of the ink flowing reversely in a thermal expansion is increased and the air chamber 13 requires the same volume as that in the case in which the ink chamber 7 is not divided. According to the third embodiment, however, it is possible to prevent such a drawback from being generated.

Figure 8:
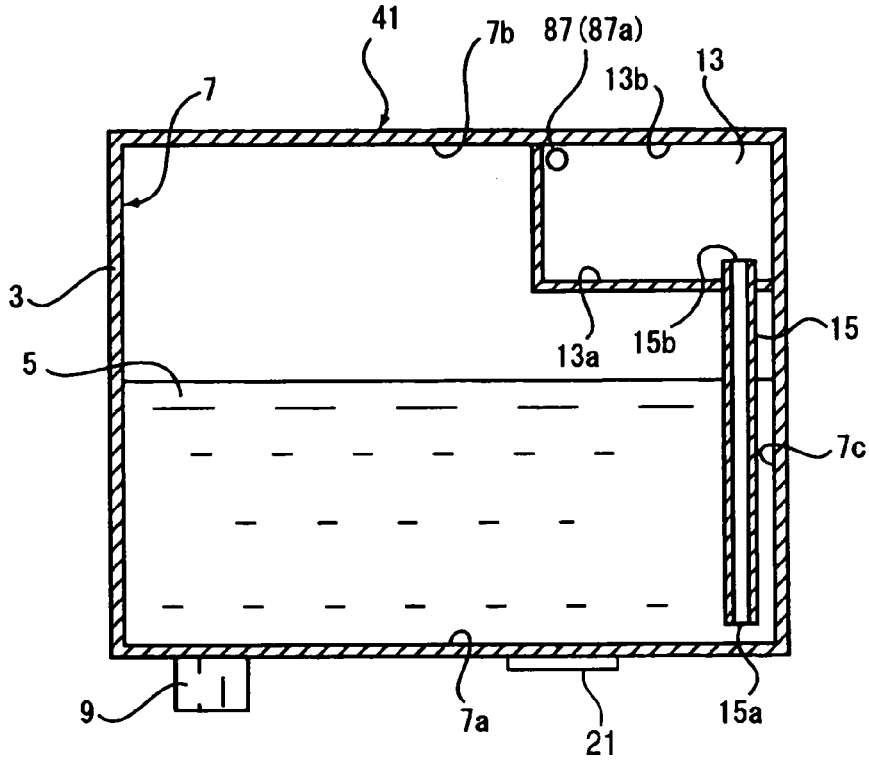
FIGS. 8(*a*) and 8(*b*) are a sectional view and a plan view showing a schematic structure of an ink cartridge according to a fourth embodiment of the liquid container in accordance with the invention.
Figure 8:
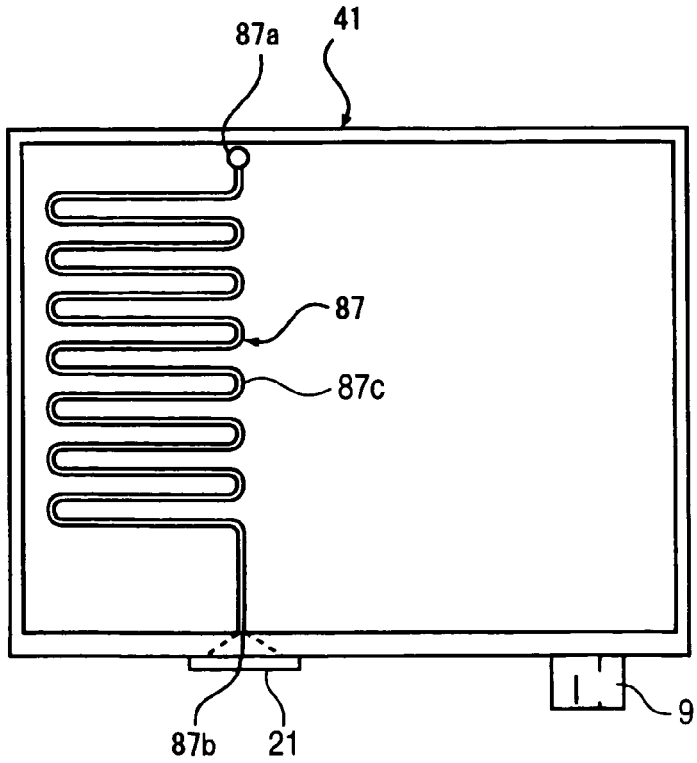

FIGS. 8(*a*) and 8(*b*) show a schematic structure of an ink cartridge 41 which is a fourth embodiment of a liquid container according to the present invention. FIG. 8(*a*) is a sectional view of the ink cartridge, and FIG. 8(*b*) is a plan view of the ink cartridge as viewed in a direction opposite to a direction of the sectional view of FIG. 8(*a*).

The ink cartridge 41 of the fourth embodiment is obtained by modifying a shape of the upper open passage and a position of the air open hole in the ink cartridge 1 of the first embodiment. Other structure of the fourth embodiment are the same as those of the first embodiment.

As shown in FIGS. 8(*a*) and 8(*b*), an upper open passage 87 in the fourth embodiment has one end opening 87*a* that is opened to the air chamber 13 at a position close to the internal surface of the ceiling wall 13*b* of the air chamber 13 and that is opened in a thickness direction of the ink cartridge 41 (i.e. a direction orthogonal to a paper surface of FIG. 8(*a*)). The one end opening 87*a* of the upper open passage 87 communicates with a flow passage 87*c* formed in a back side of the container body 3. The flow passage 87*c* forms a part of the upper open passage 87. Accordingly, in the fourth embodiment, the upper open passage 87 does not penetrate the ceiling wall 13*b* of the air chamber 13, and does bypass the ceiling wall 13*b* of the air chamber 13. The similar arrangement can be applied to the lower open passage 15.

In the fourth embodiment, the flow passage 87*c* is elongated in a meandering or circuitous manner so as to increase a length of the flow passage 87*c*. The flow passage 87*c* reaches and penetrates the bottom wall 7*a* of the ink cartridge 41 to form the air open hole which is the other end 87*b* of the upper open passage 87 and opened to the outside.

As shown in FIG. 8(*a*), the one end opening 87*a* of the upper open passage 87 is located at a position close to the corner portion 13*d* that is a diagonal position with respect to the corner portion 13*c* where the other end 15*b* of the lower open passage 15 is opened, as viewed in a rectangular section of the air chamber 13. In the fourth embodiment, as shown in FIG. 8(*b*), the other end (air open hole) 87*b* of the upper open passage 87 is sealed with a sealing film 21.

In the fourth embodiment, the other end 87*b* of the upper open passage 87, which can form the air open hole, is formed in the bottom wall 7*a*. Accordingly, the other end 87*b* can be formed so that any opening is not present in the ceiling wall 7*b*. In general, in the case of the ink cartridge, an outer surface of the ceiling wall 7*b* is often used to attach thereon a product label indicating a kind of ink stored in the ink cartridge, a serial number, etc. Therefore, if an opening to be exposed is formed in the ceiling wall, there is a possibility that an aesthetic appearance is deteriorated, or an area to which such a label can be attached is reduced to deteriorate a visual confirmation of the ink cartridge. However, in the case in which the upper open passage 87 is arranged to form the air open hole in a lower portion of the ink cartridge as in the fourth embodiment, it is possible to provide an ink cartridge which can secure a sufficient area where such a label can be attached to enhance the visual confirmation-ability of the ink cartridge, and which is natural and beautiful.

In addition, the other end 87*b* of the upper open passage 87 may not be formed in the bottom wall 7*a*, and may be formed at any other position of a side where the bottom wall 7*a* of the liquid chamber 7 is disposed, i.e. at any other position in a lower portion of the ink cartridge.

Figure 9:
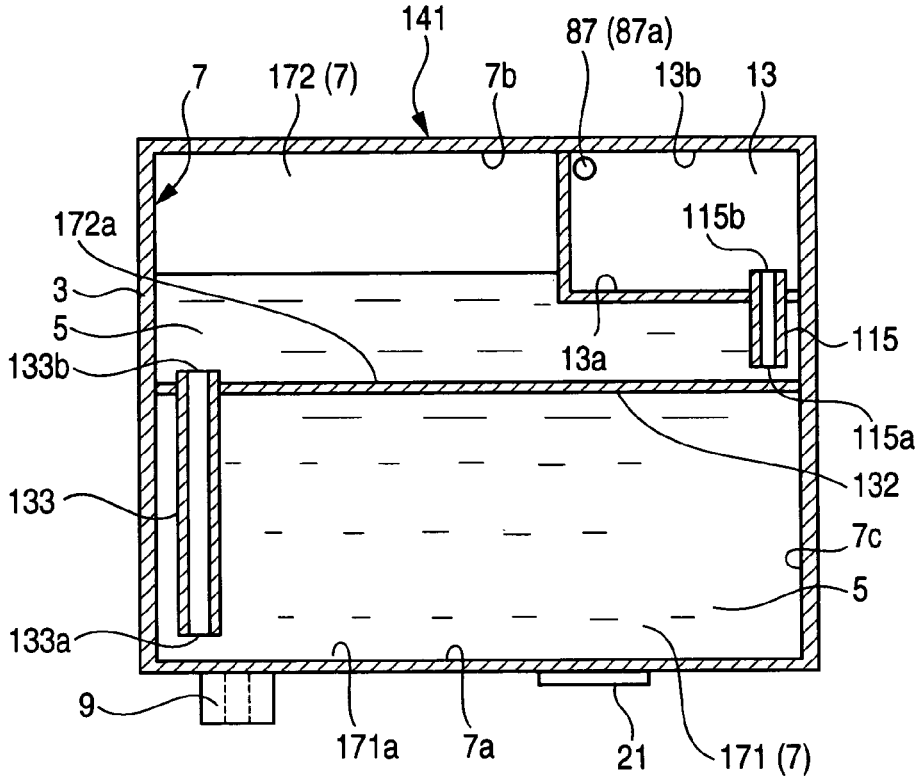
FIGS. 9(*a*) and 9(*b*) are a sectional view and a plan view showing a schematic structure of an ink cartridge according to a fifth embodiment of the liquid container in accordance with the invention.
Figure 9:
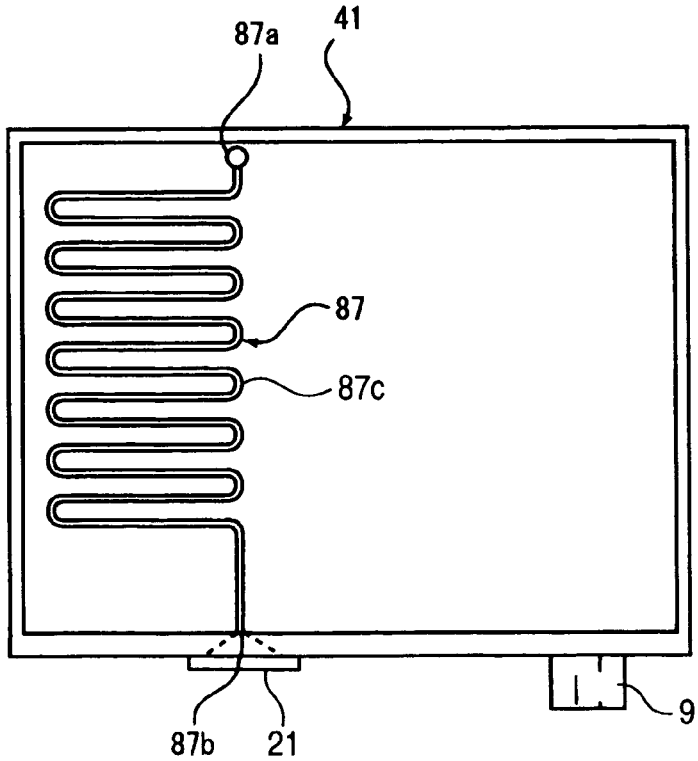

FIGS. 9(*a*) and 9(*b*) show a schematic structure of an ink cartridge 141 which is a fifth embodiment of a liquid container according to the present invention. FIG. 9(*a*) is a sectional view of the ink cartridge, and FIG. 9(*b*) is a plan view of the ink cartridge as viewed in a direction opposite to a direction of the sectional view of FIG. 9(*a*).

The ink cartridge 141 of the fifth embodiment shown in FIGS. 9(*a*) and 9(*b*) is obtained by modifying the fourth embodiment discussed with reference to FIGS. 8(*a*) and 8(*b*), and therefore the modified portions will be discussed hereinafter to eliminate repetition of the description.

In the ink cartridge 141 according to the fifth embodiment, an ink chamber 7 in the ink cartridge 41 according to the fourth embodiment is divided into a first ink chamber 171 and a second ink chamber 172 by a partition wall 132 for partitioning an inside of the ink chamber 7. The partition wall 132 extends substantially in a horizontal direction (preferably, the partition wall 132 extends obliquely downward slightly toward an end 133*b* of a coupling passage 133).

The ink cartridge 141 further has the coupling passage 133 for causing the first and second ink chambers 171 and 172 to communicate with each other. The coupling passage 133 has one end 133*a* opened to the first ink chamber 171 at a position close to an internal surface of a bottom wall 171*a* of the first chamber 171, and another end 133*b* opened to the second ink chamber 172 at a position close to an internal surface of a bottom wall 172*a* of the second ink chamber 172.

The second ink chamber 172 positioned above the first ink chamber 171 communicates with the air chamber 13 through a lower open passage 115. The lower open passage 115 has one end 115*a* opened to the second ink chamber 172 at a position close to the internal surface of the bottom wall 172*a* of the second ink chamber 172 and another end 115*b* opened to the air chamber 13 at a position close to an internal surface of the bottom wall 13*a* of the air chamber 13. The first ink chamber 171 communicates with the ink supply hole 9.

Other structure, such as a structure of the upper open passage 87 and a position and a shape of the air chamber 13 may be the same as those of the fourth embodiment.

In the ink cartridge 141 according to the fifth embodiment described above, the volume of the air chamber 13 to be secured for preventing a leakage caused by a reverse flow can be determined to correspond to the volume of the ink 5 stored in the second ink chamber 172. That is, the volume of the air chamber 13 can be set, taking into account only the volume of the second ink chamber 172, the amount of the ink stored in the second ink chamber 172 or the like.

The first and second ink chambers 171 and 172 obtained by the division communicate with each other through the coupling passage 133 having the ends 133*a* and 133*b* respectively opened to the first and second ink chambers 171 and 172 at positions close to the bottom walls 171*a* and 172*b* of the first and second ink chambers 171 and 172. Accordingly, a total amount of the stored ink 5 in the ink chamber 7 formed by the first and second ink chambers 171 and 172 can be supplied to the outside through the ink supply hole 9.

The use of the liquid container according to the invention is not restricted to the ink cartridge according to the embodiments. For example, the liquid container according to the invention is suitably used in the case in which a plurality of liquid containers are removably attached to a container attachment portion to supply a liquid or liquids to a liquid ejecting head of a liquid ejecting device. The liquid ejecting head of the liquid ejecting device discussed here includes, but not limited to, a liquid ejecting head (a print head) of a recording apparatus of an ink jet type, a coloring agent ejecting head of a color filter manufacturing apparatus for manufacturing a color filter of a liquid crystal display, an electrode material (conducting paste) ejecting head for forming an electrode of an organic EL display or an FED (a surface emitting display), a bioorganism ejecting head of a biochip manufacturing apparatus for manufacturing a biochip and a sample ejecting head to be a precision pipette.

What is claimed is:

1. A liquid container attachable to a container attachment portion of an apparatus, the liquid container comprising:

a liquid chamber, accommodating a liquid therein;

a liquid supply hole in communication with the liquid chamber and connectable to a liquid receiving portion of the apparatus side;

an air open passage causing the liquid chamber to communicate with an outside and introducing outside air into the liquid chamber as the liquid in the liquid chamber is consumed; and an air chamber provided in a portion of the air open passage and capable of storing the liquid entering the air open passage, wherein the air open passage includes:

a lower open passage having one end opened to the liquid chamber at a position close to an internal surface of a bottom wall of the liquid chamber and the other end opened to the air chamber at a position close to an internal surface of a bottom wall of the air chamber; and an upper open passage having one end opened to the air chamber at a position close to an internal surface of a ceiling wall of the air chamber and the other end capable of being opened to the outside, wherein the other end of the lower open passage is disposed close to a corner portion of the internal surface of the bottom wall of the air chamber;

the one end of the upper open passage is disposed close to a corner portion of the internal surface of the ceiling wall of the air chamber; and the corner portion of the internal surface of the ceiling wall of the air chamber is located diagonally with respect to the corner portion of the internal surface of the bottom wall of the air chamber as viewed in a direction in which the ceiling wall of the air chamber and the bottom wall of the air chamber are opposed to each other.

2. The liquid container according to claim 1, wherein the other end of the upper open passage is disposed at a side where a ceiling wall of the liquid chamber is disposed.

3. The liquid container according to claim 1, wherein the other end of the upper open passage is disposed at a side where the bottom wall of the liquid chamber is disposed.

4. The liquid container according to claim 1, wherein the air chamber is disposed in an upper part of the liquid chamber.

5. The liquid container according to claim 4, wherein a part of the ceiling wall of the liquid chamber lies in a plane in which the ceiling wall of the air chamber lies.

6. The liquid container according to any claim 1, wherein a volume of the air chamber is equal to or larger than 10% and equal to or smaller than 30% of a volume of the liquid chamber.

7. The liquid container according to claim 1, further comprising:

a sealing film, attached to the container body, for sealing the other end of the upper open passage, the sealing film being removable to open the other end of the upper open passage to the outside.

8. The liquid container according to claim 1, further comprising:

a gas-liquid separation film, provided in the upper open passage, for permitting a gas to pass therethrough and preventing the liquid from passing therethrough.

9. The liquid container according to claim 1, further comprising:

a partition wall for partitioning the liquid chamber into a first liquid chamber and a second liquid chamber;

a coupling passage for causing the first and second liquid chambers to communicate with each other, the coupling passage having one end opened to the first liquid chamber at a position close to an internal surface of a bottom wall of the first liquid chamber and another end opened to the second liquid chamber at a position close to an internal surface of a bottom wall of the second liquid chamber, wherein one of the first and second liquid chambers communicates with the air chamber through the lower open passage.

10. The liquid container according to claim 9, wherein the first liquid chamber and the second liquid chamber have volumes almost equal to each other.

11. The liquid container according to claim 9, wherein an inside diameter of the coupling passage is set to block a passage of air bubbles by forming a meniscus.

12. The liquid container according to claim 9, wherein:

the partition wall extends substantially vertically;

the first liquid chamber communicates with the liquid supply hole; and the one end of the lower open passage is opened to the second liquid chamber at the position close to the internal surface of the bottom wall of the second liquid chamber so that the second liquid chamber communicates with the air chamber through the lower open passage.

13. The liquid container according to claim 9, wherein:

the partition wall extends substantially horizontally;

the first liquid chamber communicates with the liquid supply hole; and the one end of the lower open passage is opened to the second liquid chamber at the position close to the internal surface of the bottom wall of the second liquid chamber so that the second liquid chamber communicates with the air chamber through the lower open passage.

* * * * *